United States Patent [19]

Flückiger

[11] 4,033,558

[45] July 5, 1977

[54] APPARATUS FOR CUTTING A STEEL STRAND LOCATED IN A SUPPORTING GUIDE ARRANGEMENT OF A CONTINUOUS CASTING INSTALLATION

[75] Inventor: Friedrich Flückiger, Einsiedeln, Switzerland

[73] Assignee: Concast AG, Zurich, Switzerland

[22] Filed: Sept. 29, 1976

[21] Appl. No.: 727,762

[30] Foreign Application Priority Data

Oct. 10, 1975 Switzerland ..... 13220/75

[52] U.S. Cl. ..... 266/50; 164/263

[51] Int. Cl.[2] ..... B22D 11/12

[58] Field of Search ..... 164/263, 282; 266/50; 148/9 R, 9 C, 9.6

[56] References Cited

UNITED STATES PATENTS 3,794,107 2/1974 Bollig et al. ..... 164/282

FOREIGN PATENTS OR APPLICATIONS 710,250 5/1965 Canada ..... 164/282

*Primary Examiner*—Gerald A. Dost

*Attorney, Agent, or Firm*—Werner W. Kleeman

[57] ABSTRACT

An apparatus for cutting a steel strand located in a support apron or support guide arrangement of a continuous casting installation by means of a cutting torch device. The cutting torch device, displaceable transversely with respect to the direction of travel of the strand, is arranged upon a support member of a change mechanism for elements of the support guide arrangement and can be displaced by means of this support member to desired locations of the support guide arrangement.

5 Claims, 2 Drawing Figures

APPARATUS FOR CUTTING A STEEL STRAND LOCATED IN A SUPPORTING GUIDE ARRANGEMENT OF A CONTINUOUS CASTING INSTALLATION

BACKGROUND OF THE INVENTION

The present invention relates to a new and improved construction of apparatus for cutting with the aid of a cutting torch device a continuously cast strand, typically a steel strand, located in a support guide arrangement or support apron of a continuous casting installation by means of a cutting torch device.

During the continuous casting of steel into blooms and slabs, following departure of the strand out of the mold, the strand still containing a liquid core, such strand is supported at a support guide arrangement or support apron. One such typical type of support guide arrangement consists of guide rollers, cooling plates or cooling grids arranged at opposite sides of the strand.

When a disturbance arises during continuous casting, such as for instance metal breakout, mold overflow and so forth, it may be necessary to cut the strand at desired locations within the support guide arrangement, in order to render possible or facilitate the outfeed thereof. The reasons that cutting of the strand within the confines of the support guide arrangement appear to be advantageous are multifarious and can be dictated by the construction of the casting installation or by the nature of the disturbance and so forth.

It is already known to the art, in the case of metal breakouts and the like, to cut or sever the strand beneath the breakout location with the aid of a cutting torch device which must be manually operated. The strand first must cool to such a temperature that the work can be carried out with the hand-operated cutting torch device at the region of the strand. Furthermore, it is necessary to remove the mold and/or a portion of the support guide arrangement in order to obtain the required space or freedom of access needed for carrying out the cutting operation. Cooling of the strand and achieving the requisite accessibility as well as cutting by means of a manually-operated cutting torch device requires, as a general rule, a number of hours in the case of slab castings. With arc-type or curved casting installations the strand located in the strand guide arrangement, due to its low temperature at the withdrawal and straightening machine, no longer can be straightened. In such instances, it is necessary to subdivide the curved strand portion into a number of sections and to outfeed such in the form of curved strand sections.

Additionally, there is already known in this particular field of technology change devices for changing elements of the support guide arrangement or support apron. These change devices are equipped with a support member movable approximately parallel to the lengthwise axis of the strand and possess devices for withdrawing and inserting such elements from and into the support guide arrangement.

SUMMARY OF THE INVENTION

Hence, with the foregoing in mind it is a primary object of the present invention to provide a new and improved construction of apparatus for cutting a continuously cast strand while in a support guide arrangement of a continuous casting installation in a manner not associated with the afore-mentioned drawbacks and limitations of the prior art proposals.

Another and more specific object of the present invention aims at the provision of a new and improved construction of apparatus which, in the event of a disturbance arising during continuous casting, enables cutting of hot strands within the support guide arrangement while considerably shortening the time needed for the cutting operation.

Now in order to implement these and still further objects of the invention, which will become more readily apparent as the description proceeds, the apparatus of the present development is manifested by the features that the cutting torch device, which is displaceable transversely with respect to the direction of travel of the strand, is arranged at the support member of a change mechanism for elements of the support guide arrangement and can be displaced or shifted by means of this support member to desired locations of the support guide arrangement.

By means of the apparatus of the invention it is possible, in the case of a disturbance arising during continuous casting, to cut the strand at desired locations of the support guide arrangement with an automated device and with very little expenditure in time. Thus, it is possible to still straighten the strand portion located below the cutting location and, as a general rule, still possessing sufficiently high temperature at the withdrawal and straightening machine, to thereby avoid material- and time losses. By using the already available change mechanism for elements of the support guide arrangement, the apparatus of the invention does not require any additional space within the installation, and furthermore, the investment costs are correspondingly small.

In the case of continuous casting installations constructed to operate at high continuous casting speeds and for the thus required small mutual spacing of the support guide elements, it is advantageous if during cutting guide rolls or rollers are displaceable at the side of the strand confronting the cutter at the desired locations of the support guide arrangement. In this way the spatial conditions for the transverse displacement of the cutter are improved and damaging the rollers during torch cutting is avoided.

In order to protect the strand guide elements from the liquid steel flowing out of the cutting joint or line at the side of the strand facing away from the cutter, it is advantageous to likewise provide displaceable guide rollers at the desired locations of the support guide arrangement. In this regard it is particularly advantageous if the support member is provided with an insertable slag catch basin or vat at the side of the strand facing away from the cutter during the cutting operation.

A particularly advantageous application of the invention is realised in the case of a continuous casting installation of the type wherein, following the continuous casting mold there is arranged a first, straight support guide portion and subsequent thereto a, second, curved support guide portion, if there is displaceable at both side of the strand at least one respective roller or roll at the transition zone between the straight and the curved or arc-shaped support guide portions and the support member is provided with an insertable slag catch basin or vat at the side of the strand facing away from the cutter during the cutting operation. After there has arisen a disturbance during operation of the continuous casting installation it is possible for the straight strand portion to be removed in the shortest amount of time from the support guide arrangement in a direction opposite to the direction of travel of the strand. The strand located in the curved strand guide portion, as a general rule, following the cutting operation, still can be outfed at such a high temperature that there is possible straightening of the strand without overloading the withdrawal and straightening machine.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
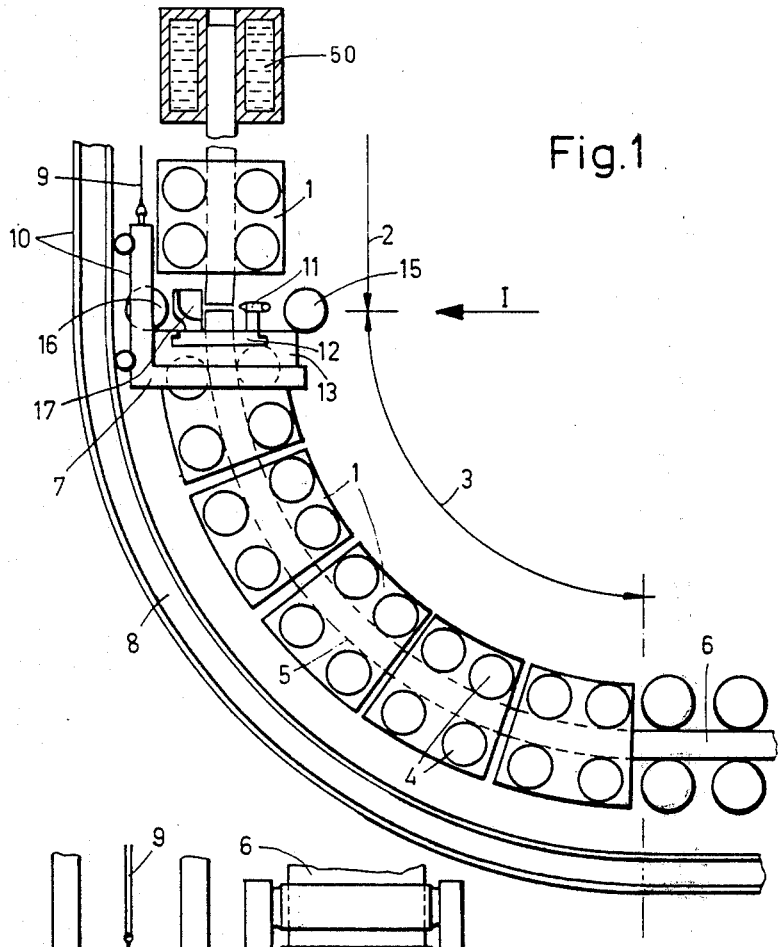
FIG. 1 is a schematic side view of a portion of the strand supporting guide arrangement constructed according to the invention.
Figure 2:
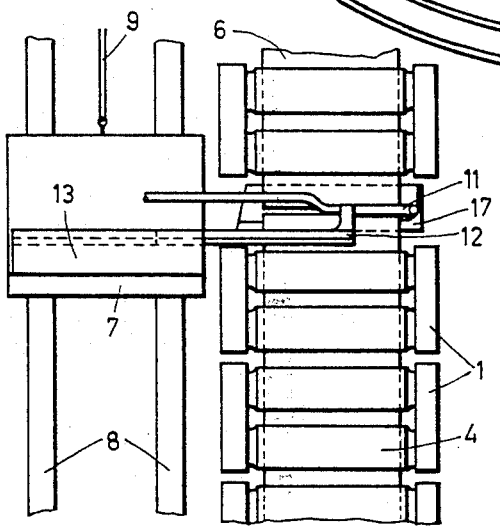
FIG. 2 is a view of part of such strand guide arrangement, looking in the direction of the arrow I according to FIG. 1.

Turning attention now to the drawings, it is to be understood that only enough of the structure of the continuous casting installation has been shown and will be discussed herein in order for those skilled in the art to completely understand the underlying principles of the present invention. Hence, in FIGS. 1 and 2 it is to be recognized that reference character 1 designates elements of a partially curved support guide arrangement for a continuously cast strand, generally indicated by reference character 6. A first portion of the support guide arrangement, following a merely schematically illustrated continuous casting mold 50 of conventional design, and which first portion is bounded by the dimension line 2, will be seen to be linear or straight and a second portion of the support guide arrangement, bounded by the dimension line 3, is curved. Oppositely situated rollers or rolls 4 of the elements 1 of the support guide arrangement guide the continuously cast strand 6. Arranged adjacent to the strand guide arrangement is a change mechanism 10 for the elements 1 of the support guide arrangement. This change mechanism 10 essentially consists of supports 8 extending parallel to the path of travel 5 of the strand, a support member 7 which can travel upon the supports 8 and a not particularly illustrated but conventional travel drive cooperating with a rope cable 9 or equivalent structure.

A torch cutting device 11 is arranged at the support member 7 of the change device 10. This torch cutting device 11 is connected with a carriage 12 which is displaceable in a frame 13 transversely with respect to the direction of travel of the strand 6. By means of a not particularly illustrated feed mechanism the carriage 12, guided in the frame 13, can move the cutting torch device 11 over the strand 6. At the side of the strand 6 which confronts the cutting torch device 11 during the cutting operation, a guide roll or roller 15 is displaceable away from the strand surface. The guide roll 15, for reasons of clarity in illustration, has not been particularly shown in FIG. 2. This roll or roller 15 can be moved alone or in conjunction with neighboring rollers by means of any conventional and therefore not particularly illustrated displacement devices, such as hydraulic cylinders or equivalent structure. In the case of change devices or mechanisms which travel upon the curved inner side or curved outside of the strand, the rolls 15 and 16 respectively, for instance also can be removed by the change mechanism itself.

At the side of the strand 6 which faces away from the cutting torch device 11 there is likewise provided a guide roll 16 which is displaceable away from the strand surface. In this way there can be provided the necessary space for an insertable slag catch or receiving basin 17 likewise mounted at the frame 13. The gap between the slag catch or receiving basin 17 and the strand surface can be sealed, for instance by asbestos. The slag catch basin 17 is provided with cooling- and flushing water devices for cooling and flushing away the slag formed during cutting.

The operation of cutting a strand occurs as follows:

If, for instance, in the first straight or linear strand guide zone, bounded by the arrow 2, following the mold, there occurs a metal breakout which prevents any further transport of the strand 6, then with the strand guide arrangement illustrated by way of example, the strand 6 is advantageously cut between the straight and the curved strand guide portion. For this purpose, the rollers or rolls 15 and 16 are displaced away from the strand surface at desired locations. In the meantime the frame 13 together with the cutting torch device 11 and the slag catch basin or vat 17 are placed upon and secured to the support member 7 which, as a general rule, is in its rest position next to the withdrawal and straightening machine. Thereafter, the support member 7 is shifted to the desired location of the support guide arrangement. Not particularly illustrated supply hoses and supply lines for the cutting torch device 11, the slag catch basin 17 and for the mechanical movement of the carriage 12 are coupled with the supply network. The cutting cut can be remotely controlled and thereafter the lower bent strand portion is withdrawn downwards and the straight strand portion is raised upwards. Depending upon the dimensions of the installation and the cooling conditions for the strand, it also can be however advantageously cut after its departure out of the bending apparatus.

In the case of casting installations having arc-shaped molds, as a general rule, the first support guide zone following the mold can be exchanged by carrying out an upward displacement. If there is required in such an installation a separation cut following the first zone, for instance after there has occurred metal breakout, then the required space for performing the cutting operation can be made available in that the first zone welded with the strand is upwardly ejected by the driver. After torch cutting the first zone can be lifted-out together with the through-cut strand portion.

The change mechanism for the elements 1 of the support guide arrangement can be arranged in vertical and/or in curved strand guide portions. In the case of arc-type casting installations the change mechanism is also referred to as a segment change device or the like, wherein individual rolls or individual pairs or a number of roll pairs can be exchanged.

The combination of the torch cutting device 11 with the change device or mechanism can be employed for each of the many known constructions of change devices.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. An apparatus for cutting a continuously cast strand, especially a steel strand, located within a support guide arrangement of a continuous casting arrangement by means of a torch cutting device, comprising a support guide arrangement incorporating strand support elements for guiding the continuously cast strand along a predetermined direction of travel, a cutting torch device, means mounting said cutting torch device to be transversely displaceable with respect to the direction of travel of the strand for cutting the strand, a change mechanism for the elements of the support guide arrangement, said change mechanism including a support member, the cutting torch device being arranged upon the support member of the change mechanism and displaceable by means of said support member to desired locations of the support guide arrangement.

2. The apparatus as defined in claim 1, wherein at least one guide roll is displaceable to desired locations of the support guide arrangement at the side of the strand confronting the cutting torch device during cutting.

3. The apparatus as defined in claim 1, wherein at least one guide roll is displaceable to desired locations of the support guide arrangement at the side of the strand facing away from the torch cutting device during cutting.

4. The apparatus as defined in claim 1, further including a slag catch basin provided for the support member, said slag catch basin being insertable at the side of the strand which faces away from the torch cutting device during cutting.

5. The apparatus as defined in claim 1, including a casting mold, said support guide arrangement following said mold and comprising a first substantially linear support guide portion and thereafter a second curved support guide portion, at least one respective roller displaceably arranged at a transition zone between the linear and the curved support guide portions to each side of the strand, and an insertable slag catch basin provided for the support member, the insertable slag catch basin being insertable at the side of the strand facing away from the torch cutting device during cutting.

* * * * *